United States Patent [19]

Tsunoi

[11] 4,227,797

[45] Oct. 14, 1980

[54] WET DEVELOPING APPARATUS FOR ELECTROSTATIC LATENT IMAGES

[75] Inventor: Haruo Tsunoi, Kawasaki, Japan

[73] Assignee: Canon Kabushiki Kaisha, Tokyo, Japan

[21] Appl. No.: 961,453

[22] Filed: Nov. 16, 1978

[30] Foreign Application Priority Data

Nov. 24, 1977 [JP] Japan ..... 52-141000

[51] Int. Cl.[3] ..... G03G 15/10

[52] U.S. Cl. ..... 355/10; 118/659; 118/661

[58] Field of Search ..... 355/3 R, 10; 354/318; 427/15, 17; 118/659, 661

[56] References Cited

U.S. PATENT DOCUMENTS

| | | | |
|---|---|---|---|
| 3,980,404 | 9/1976 | Townsend | 355/10 |
| 4,002,476 | 1/1977 | Wales | 427/15 X |
| 4,025,185 | 5/1977 | Wilson | 355/10 |
| 4,043,657 | 8/1977 | Karnik | 355/10 |
| 4,052,959 | 10/1977 | Hayashi et al. | 355/10 X |

*Primary Examiner*—Fred L. Braun

*Attorney, Agent, or Firm*—Fitzpatrick, Cella, Harper & Scinto

[57] ABSTRACT

A wet developing apparatus of the type which is provided with a rotary member for developing an electrostatic latent image carried on a latent image carrier wherein said member supplies a liquid developer to the carrier and recovers residual liquid developer from the carrier by use of an elastic deformation of the rotary member, which wet developing apparatus is characterized in that the relative position between said rotary member and the latent image carrier is determined so that the width of said rotary member, measured along the axial direction in which said rotary member comes in pressure contact with said latent image carrier, is within the range of from the maximum width of the area in which an electrostatic latent image can be carried by said carrier to the total width of said carrier.

9 Claims, 12 Drawing Figures

WET DEVELOPING APPARATUS FOR ELECTROSTATIC LATENT IMAGES

BACKGROUND OF THE INVENTION

1. Field of the Invention

The present invention relates to a wet developing apparatus of the type in which an electrostatic latent image formed in an electrophotographic process or an electrostatic recording process is visualized with liquid developer.

In the art of image formation such as electrophotography, electrostatic printing, electrostatic recording and the like, various developing methods have been known and used to visualize or develop an electrostatic latent image on a latent image carrier such as a photosensitive medium using a photoconductive substance or an electrostatic recording material. In these known developing methods there is generally used so-called toner, namely electroscopic particles which are more or less selectively drawn to or repulsed from the electrostatic charge of the latent image. When such toner is applied to the surface on which a latent image is carried, the developer particles adhere to the latent image area for direct reproduction or adhere to the area outside of the latent image for reversible reproduction.

When developing is carried out with a developer in a form of dry powder it is referred to as a dry developing method and when it is carried out with liquid developer prepared by dispersing such toner in a carrier liquid, it is referred to as a wet developing method. Both of these developing methods are widely known at present. Compared with the dry developing method, the latter mentioned method, that is, the wet developing method has such advantage that the apparatus required for carrying out the method is relatively simple in structure and that troubles involved in carrying out the method such as scatter of developer can be minimized. Therefore, the wet developing method is preferably used for simple type image forming apparatus rather than the dry method.

The wet developing method may be defined as such developing method which comprises the step of making liquid developer come in contact with the latent image carrying surface. The liquid developer is prepared by dispersing toner particles in a suitable dielectric carrier liquid having a volume resistivity larger than about $10^{10}$ Ωcm and a dielectric constant less than 3 (for example, paraffin hydrocarbons). When contacted with the latent image carrying surface, the toner particles dispersed in the carrier liquid are drawn to the electrostatic latent image and adhere thereto so as to visualize the latent image.

2. Description of the Prior Art

As wet developing methods there are known various types of technique such as cascade, immersion, jet stream, and roller etc. In the roller type of developing method, the supply of liquid developer is effected by using a roller made from material capable of retaining liquid such as sponge, felt and the like.

Among them, it has been recognized in the art that wet developing methods can be carried out advantageously using an elastic roller having a liquid-retaining property and a porous surface through which liquid is allowed to move away into and come from the roller. The elastic roller serves as a liquid developer supplying means, and an electrostatic latent image on a latent image carrier is developed along the area in which the elastic roller comes in pressure contact with the carrier. Since, in this method, the supply of liquid developer squeezed out from the roller and the recovery of residual developer by sucking can be effected simultaneously relying upon the elastic deformation of the roller itself, developing of a latent image is more advantageously carried out as compared with other known wet developing methods such as that of the immersion tank type or that of the jet stream type.

One of such elastic rollers is disclosed in Japanese Patent Application laid open No. 40336/1977. The developing roller disclosed therein has a sponge layer surrounding the circumference of a roller and a flexible mesh member covering the sponge layer. The developing roller rotates while maintaining its pressure contact with the surface of a rigid member such as photosensitive medium or insulating member to form a desired nip width therebetween. Liquid developer contained in the sponge layer is squeezed out by the contact pressure and residual developer is sucked or absorbed again into the sponge layer when the layer expands to its original state. This type of developing roller is expected to obtain a high appreciation of its applicability for devices adapted for developing electrostatic latent image.

Today, speed-up of wet developing process is an important problem in the art. In order to solve the problem, it is absolutely necessary to supply to the latent image carrier surface a liquid developer of high concentration at a high speed using an elastic roller and also to recover residual developer from the carrier surface at a high efficiency. Of course, it should be assured at the same time that a developed image of high quality be produced thereby. The above described action of the elastic roller cooperating with the latent image carrier such as a photosensitive drum is particularly important to satisfy the requirements mentioned above. The elastic roller must function uniformly throughout the area where the roller is acting. Otherwise, there may be caused some faults such as irregular development.

It is never easy to satisfy all the requirements as mentioned above. At least, the elastic roller used for developing must be made uniformly throughout all of the outer circumferential surface areas. Furthermore, a proper positional relation must be established between the working surface of the roller and the latent image carrier, and if such proper positional relation is not established the elastic roller will not function so well as expected.

SUMMARY OF THE INVENTION

Accordingly, it is an object of the present invention to provide a developing apparatus for carrying out the above described wet developing method with an elastic roller which is improved with respect to efficiency in developing and quality of developed image.

It is another object of the invention to provide a novel developing apparatus which enables the carrying out of developing with a higher accuracy for an extended life time.

It is a further object of the invention to provide a wet developing apparatus of the above mentioned type which is simple and compact in structure and has a sufficient durability for use.

In order to attain the above objects according to the invention there is provided a developing apparatus of the type including a rotary member to develop the latent image on a latent image carrier while applying a liquid developer thereto and recovering residual developer therefrom relying upon the elastic deformation of the rotary member, which is characterized in that the relative position between the rotary member and latent image carrier is determined so that the width of the rotary member, measured along the axial direction in which the rotary member is in pressure contact with the latent image carrier, is smaller than the full width of the carrier but longer than the width of its effective area useful for carrying an electrostatic latent image thereon.

Other and further objects, features and advantages of the invention will appear more fully from the following description taken in connection with the accompanying drawing.

DESCRIPTION OF THE PREFERRED EMBODIMENTS

Since, as previously noted, there are various kinds of developing rollers useful for the invention, it is impossible to show and describe all of the elastic rollers herein. Therefore, some typical examples of the roller will be described in detail for the purpose of illustration of the invention by reference to the drawings.

Figure 1:
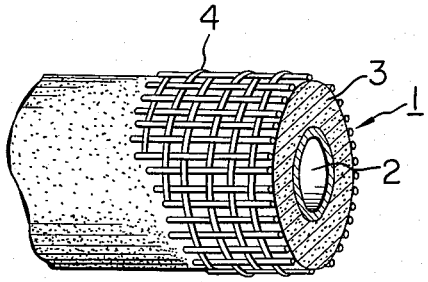
FIGS. 1 and 2 show, in partial perspective view, typical examples of a developing roller used in the present invention.

FIG. 1 shows one concrete example of such developing roller which is basically composed of a core roller member made as a rotary shaft, an elastic member surrounding the core roller member and a flexible mesh member covering the elastic member and forming a top surface of the roller.

In FIG. 1, reference numeral 1 generally designates an elastic roller. The eleastic roller comprises a core member 2 made of a rigid shaft like body of metal, hard synthetic resin or the like, a layer of elastic foam structure such as polyurethane foam material 3 provided on the circumference of the core member 2 and a mesh member 4 covering the foam structure 3. The foam member 3 is fixedly secured onto the core member 2 and the mesh member 4 is in a form of seamless cylinder enclosing the outer surface of the foam structure 3. The mesh member 4 is held in the position fixedly by the restitution force which the elastic foam member 3 exerts on the inside surface of the mesh member. Thus, when the core shaft member 2 of the roller is driven into rotation, the elastic foam member 3 and the mesh member 4 also rotate together with the core shaft member 2.

Since the member 3 is of foam structure containing a number of open cells, it is able to retain liquid therein and possesses a liquid permeability. Furthermore, since the cells are in communication with each other and elastically deformable, the foam layer 3 can absorb liquid into it and squeeze out liquid therefrom.

The mesh member 4 may be formed by weaving wire of metal such as stainless steel or yarn of natural or synthetic fiber into a flexible net. Through the openings of the mesh member 4, liquid comes into and out of the foam member 3. Thus, when the elastic roller 1 impregnated with liquid is compressed, the liquid is squeezed out from the foam member 3 to the exterior of the roller through the mesh. On the contrary, when the roller is released from the compression force and the foam structure member 3 is restored to its original state, the residual liquid on the surface of the mesh member 4 is absorbed into the foam member 3 through the mesh member. In case that the mesh member constitutes a top surface of the elastic roller as in the shown example, the mesh member 4 may have a mesh value in the range of from 60 to 400 mesh. However, considering the fact that there may be produced on the developed image a contact mark of the mesh member, and on account of convenience in use, it is preferable to use a mesh member in the range of from 180 to 300 mesh. The mesh member may be netting of plain weave, twill or satin weave. Products obtained by deforming such netting under pressure also may be used. The mesh member may be placed on the foam member 3 in any orientation. While in the example of FIG. 1 the mesh member 4 is placed on the foam member 3 in such orientation that the weft of the netting extends in parallel with the rotational axis of the roller, the netting may be placed on the foam member in such manner that the weft extends obliquely to the rotational axis with a certain angle.

Figure 2:
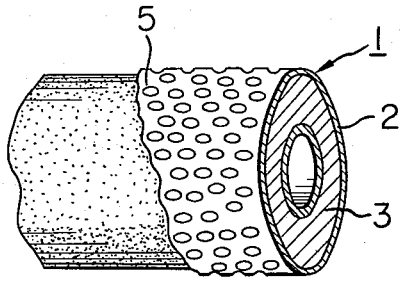

Within the scope of the invention, the structure of the above described elastic roller may be modified in various manners. The member forming the top surface of the elastic roller used in the invention may be composed of any material that is provided with openings connecting the interior and exterior thereof, is flexible in a direction perpendicular to the outermost surface coming in contact with another rigid surface, and retains permeability of the openings in case of such contact. Therefore, the member used to form a top surface of the elastic roller is not limited only to a mesh member as shown in FIG. 1. Other flexible and porous materials also can be used for this purpose. For example, a metal film or a resin film having a number of pores formed therein as illustrated in FIG. 2 also may be used as the top surface member covering the foam structure member 3. The porous film sleeve 5 shown in FIG. 2 has a number of openings which provide a communication between the interior and exterior of the roller and are in the form of a circle. The openings may have other shapes such as rectangular, oval, mosaic or combinations thereof. Also, it is not always necessary to form the layer of foam structure 3 shown in FIGS. 1 and 2 as a single layer. It may be formed as a multilayer member.

In order to point out the disadvantages involved in the conventional developing system, a description will be made of an image forming apparatus in which the above described elastic roller is incorporated as a part of its developing device.

Figure 3:
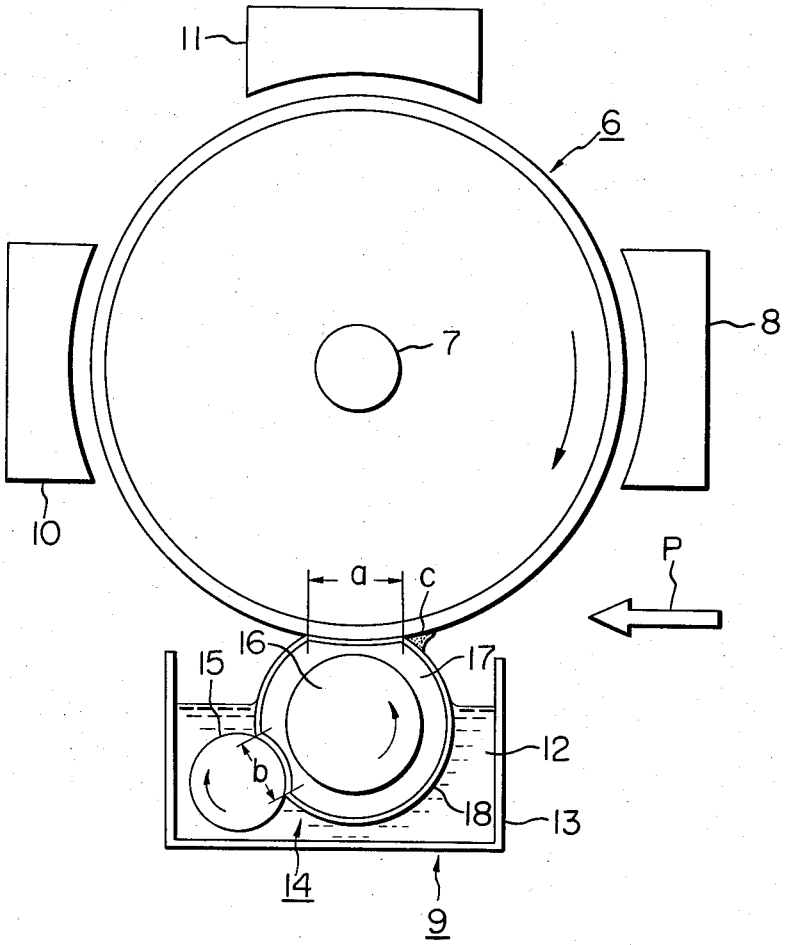
FIG. 3 is a schematic cross-sectional view of a wet developing apparatus in which a developing roller as shown in FIG. 1 is used.

FIG. 3 schematically shows the arrangement of an electrophotographic copying machine provided with an elastic roller for developing. Designated by 6 is a photosensitive medium in a form of drum which rotates in the direction of the arrow about its rotational axis 7. Numeral 8 designates a latent image forming part in which a latent image is formed on the photosensitive drum 6. Numeral 9 designates a developing part, 10 is a transferring part for transferring the developed image onto a transfer sheet and 11 is a cleaning part in which an unnecessary portion of the developer is cleaned off from the surface of the photosensitive drum and an unnecessary portion of the latent image is erased. The developing part 9 is disposed under the photosensitive drum 6. The developing part comprises a liquid container 13 containing an amount of liquid developer 12, a developing roller 14 a portion of which is dipped into the liquid developer 12 in the container 13 and a squeeze roller 14 in pressure contact with the developing roller 14. The developing roller 14 is of the same type as shown in FIG. 1 and is composed of a core roller member 16, an elastic member of foam structure 17 which may be, for example, a foamed polyurethane, and an endless mesh member 4 enclosing the foam member 17. The photosensitive drum 6 and the developing roller 14 are in contact with each other under pressure and rotate in the same direction (in the direction of the arrow) at a nearly equal speed. With the foam member fully impregnated with the liquid developer 12, the developing roller comes into contact with the photosensitive drum 6 while forming a nip portion (portion a in FIG. 3) therebetween. Liquid developer squeezed out from the roller (see portion c in FIG. 3) and developer present in the area between the drum 6 and the roller 14 (see portion a in FIG. 3) effect development the electrostatic latent image formed on the drum.

As the drum and the roller rotate, the part of the roller 14 once contacted by the drum 6 gradually goes apart from the surface of the photosensitive drum. At the time, residual liquid developer existing in the vicinity of the drum surface is absorbed into the elastic foam member 17 by the restoring force of the foam structure. When further rotated, the contacted portion of the developing roller 14 comes into pressure contact with the squeeze roller 15 in the reservoir of the liquid developer 12 and thereby exchange and supply of developer to the developing roller are effected. Thus, the developing roller becomes ready for the next cycle of developing.

Figure 4:
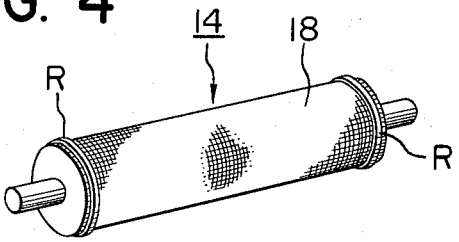
FIG. 4 illustrates the developing roller used in the apparatus shown in FIG. 3.

As seen in FIG. 4, the elastic developing roller designed in accordance with the prior art has clamp rings R at both ends of the developing roller 14. These clamp rings are used to prevent the netting 18 from being frayed gradually at the end portions of the developing roller 14. Hitherto, the use of such clamp ring has been considered to be indispensable for protecting the netting against fraying.

Figure 5:
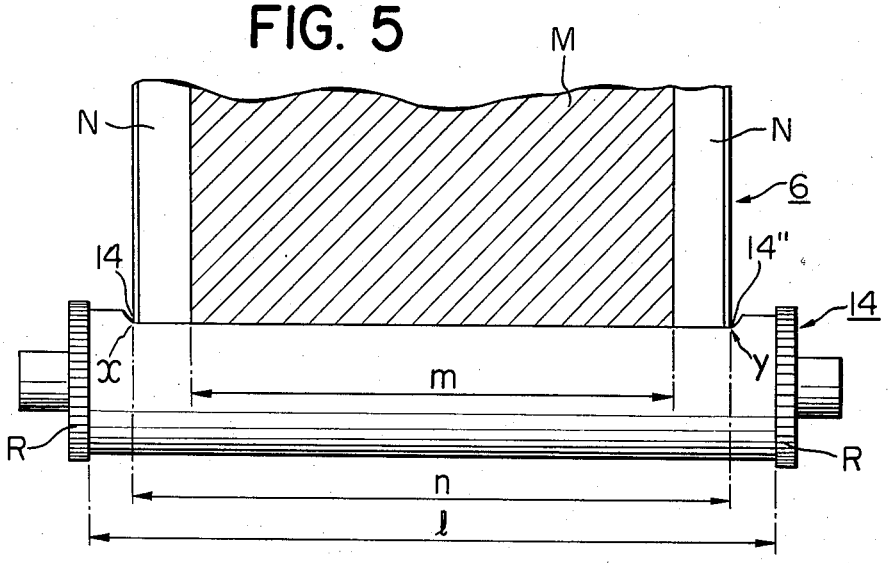
FIG. 5 is another view of the apparatus shown in FIG. 3, showing only the essential part of the apparatus.

FIG. 5 shows the photosensitive drum 6 and the developing roller 14 used in the apparatus shown in FIG. 3 in detail, as a side view looked in the direction of arrow P in FIG. 3. The hatched area M of the photosensitive drum 6 indicates such area on which a latent image can be formed. In this case, it is required that the developing roller 14 should contact completely with the drum 6 under pressure at least over the full width m of the area M in the axial direction. In other words, the width m measured in the axial direction means the range of area M to be subjected to the developing action. End area N of the photosensitive drum 6 indicates such area which the photosensitive medium requires, as a minimum area, to obtain the necessary physical and mechanical strength thereof including the area M and which is usually formed from a rigid material.

Since the developing roller has clamp rings R at its both ends as mentioned above, it is required to avoid any direct contact between the ring R and the photosensitive drum 6. Otherwise, no uniform pressure contact is attainable between the developing roller 14 and the photosensitive drum 6 and in the worst case either one of the two members may be damaged. To satisfy this requirement, the developing roller is conventionally so designed that the developing roller has an axial length larger than the full width of the photosensitive drum and the roller projects beyond the drum at the both ends. In FIG. 5, the length of the developing roller is indicated by l which is longer than the full width n of the photosensitive drum 6. This positional relation established between the developing roller and the photosensitive drum, however, brings forth various troubles and disadvantages as will be described hereunder.

One of the important disadvantages is that the surface layer of the developing roller 14 is damaged at the portions contacted by the edge portions x and y of the photosensitive drum 6. This damage is mainly caused by the difference in hardness between the two portions in contact with each other. The damage becomes greater in proportion to the number of cyclic developing operations and at last the surface of the developing roller 14 may be broken away. When the surface of the developing roller is formed by a mesh member as previously described, a breaking at a portion of the mesh member will cause an irregular distribution of tension over the mesh member and thereby there will be formed a crease. If the latent image on the photosensitive drum is developed with such a developing roller with its top surface mesh member being creased, then there may appear an unpleasant strip mark in the developed image due to the crease or there may be caused reduction of the resolving power by it. In a case where development is effected while applying a bias voltage to the developing roller 14, such breaking of the surface member will make it impossible to apply a constant voltage to the roller and to produce developed images of the desired level of sharpness in a stable manner.

Another important disadvantage is that sunken portions 14' and 14'' are formed at the end parts of the developing roller 14 and residual developer accumulates therein as sludge. The sunken portions 14' and 14'' receive not only such residual developer squeezed out from the developing roller 14 but also such developer partly transformed into a sludge at the cleaning part not shown and dropped from the part. Such sludgy developer accumulated on the developing roller 14 is solidified since the content of carrier liquid in the developer evaporates off during the rest time of the apparatus. These solids formed in this manner, even when they are again recovered into the reservoir of the liquid developer, are not fully disolved or dispersed into the liquid developer and they remain in the liquid developer as masses, several mm in particle size. Such toner masses may be delivered to the surface of the photosensitive drum 6 and adhere thereto. If this occurs, there will be produced a developed image containing therein a number of dark spots which make the image unpleasant. Moreover, there may occur the case in which such toner masses block the fine openings of the porous surface layer and therefore the developing roller no longer functions properly.

The present invention provides an improved wet developing apparatus which eliminates the above described disadvantages completely. Now, the improvements made by the present invention will be described in detail with reference to FIGS. 6 through 10.

Figure 6:
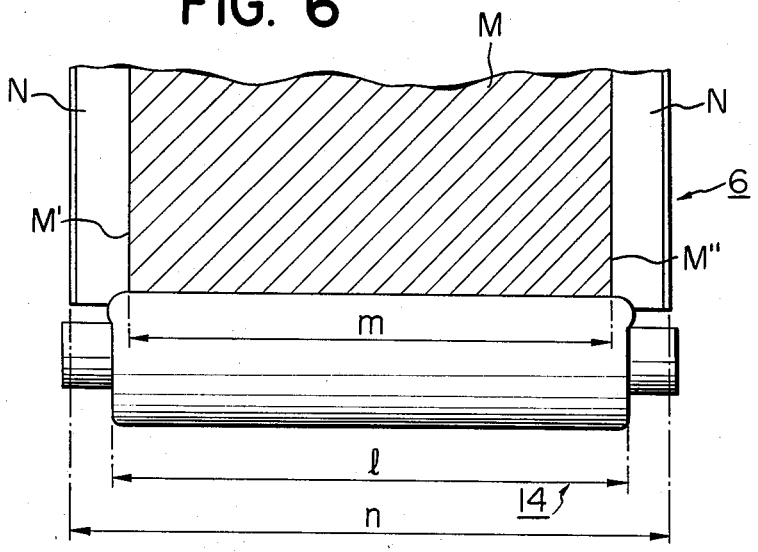
FIGS. 6 and 8 are enlarged views of a portion of a wet developing apparatus including a developing roller designed and arranged in accordance with the present invention.

FIG. 6 is a view similar to FIG. 5 but showing an embodiment of the present invention. The photosensitive drum 6 shown in FIG. 6 again includes a main central area M (hatched area) on which a latent image can be formed, and end supporting areas N, N required to assure the electrophotographic characteristics of the photosensitive medium and to stabilize the mechanical strength of it. In the areas N, N, no latent image is formed. The working surface of the developing roller 14 must be contacted with the photosensitive drum at least throughout the full width m of the latent image forming area M. Otherwise, developing at the marginal portions M′ and M″ of the area M may be incomplete.

To satisfy the requirements and also to completely eliminate the above described disadvantages involved in the prior art developing apparatus, the present invention proposes to establish a novel and particular positional relation between the photosensitive drum and the developing roller. According to the invention, the maximum width l of the working surface of the developing roller measured in its axial direction is selected in such manner that the width l of the developing roller 14 is larger than the width m of the image forming area M of the photosensitive drum 6 and less than the total width n of the drum. It has been found that this feature of the present invention brings forth a particular effect to prevent breaking of the developing roller 14 as described above, to essentially lengthen the life of the developing roller and to assure a good and stable developing performance thereof. It has been also found that the above mentioned trouble of accumulation of residual developer at the end parts of a developing roller can be eliminated completely and a successful recovery and reuse of the residual developer can be assured by the feature of the present invention.

In embodying the present invention, it is very important and essential to preset the developing roller 14 in such manner that the developing roller may work uniformly throughout the full axial width l of its working surface. In other words, the axis of the developing roller should be positioned in parallel with the axis of the photosensitive drum 6 so that the developing roller may be kept in pressure contact with the drum surface uniformly throughout the full width l of the developing roller so as to prevent any irregularity in developing on the photosensitive medium. Also, it should be noted that the effect of the present invention can be obtained satisfactorily only when the developing roller has an the effective working surface which covers nearly all of the circumferential area of the roller.

Figure 7A:
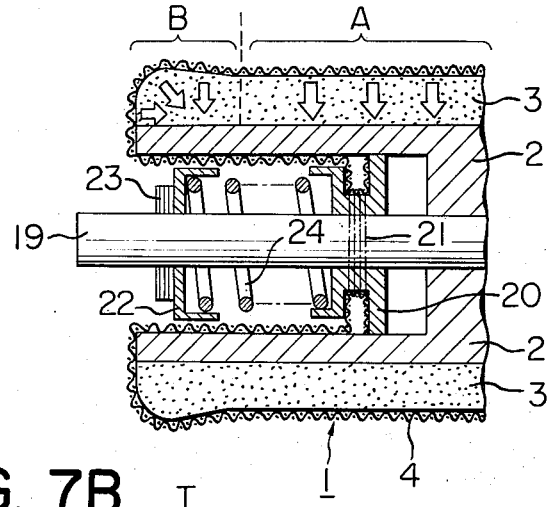
FIGS. 7(*a*) to (*c*) are explanatory views of elastic rollers showing preferred embodiments of the present invention respectively.
Figure 7B:
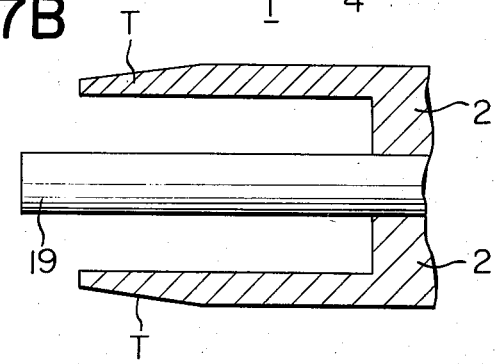
Figure 7C:
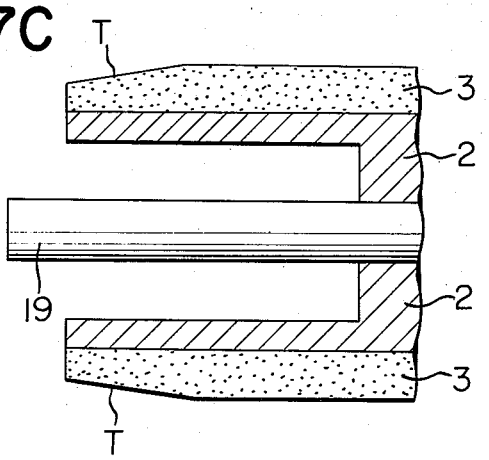

FIG. 7 illustrates such developing rollers suitably used in the present invention.

FIG. 7(*a*) is a partial sectional view of a developing roller similar to that shown in FIG. 1, showing only one end part of the roller schematically for the purpose of illustration. The developing roller comprises a core member 2 serving also as a roller shaft member, an elastic member of foam structure 3 fixedly secured on the core member in such manner as to enclose the latter and a netting 4 covering the foam member 3. At both ends of the roller, the netting 4 is folded back into the interior of the core member 2 and extends to a rigid movable block 20 to which the free end of the netting is secured by means of a suitable fastening member such as fastening yarn or band 21. The rigid block 20 is mounted on a rotary shaft 19 and slides along the rotary shaft. Facing the rigid movable block 20 in the interior of the core member 2, there is also provided another rigid movable block 22. The rigid block 22 is mounted also on the rotary shaft 19 slide movably along it, but the movement of the second block 22 in the direction toward the open end of the core member 2 is limited by a stopper 23. A coil spring 24 is interposed between the two rigid blocks 20 and 22. Since the second block 22 abuts against the stopper 23, the spring force of the coil spring 24 is exerted solely on the first block 20 to move it into the interior of the core member 2. As a result, a tension is applied to the netting 4. With the structure described above, nearly all of the outer circumferential surface area of the elastic roller 1 can be used as the effective working surface of the roller.

However, it has been found that the developing roller illustrated in FIG. 7(*a*) gives rise to a problem. That is, in FIG. 7(*a*), reference character A designates the central area of the roller 1 and B designates the end part area thereof. As indicated by arrows in FIG. 7(*a*), the foam member in the area A is uniformly compressed toward the center line of the roller by the netting 4. But, in the end part area B, the foam member 3 is subjected not only to the compression force toward the center line but also to the compression force working in a direction in parallel with the center line. Under this condition, the foam member 3 in the area B has a tendency to thicken and bulge as seen in the drawing of FIG. 7(*a*). When such elastic roller 1 with its end portions bulged is brought into pressure contact with another member, a larger load will be applied to the area B as compared with the area A. This produces differences in elastic deformation between the two areas A and B. The developing roller 1 is no longer able to work for squeezing out and absorbing the liquid developer uniformly throughout its working surface as desired. Moreover, the elasticity of the foam member 3 is lost earlier at the area B than at the area A and therefore the useful life of the roller 1 is reduced as a whole. When the developing roller has to function also as an electrode, the irregularity of density in the foam member 3 makes it impossible for the roller to have a uniform electrode effect throughout all of the roller surface area.

The problems of developing rollers described above can be solved almost completely by using such developing roller as shown in FIGS. 7(*b*) and (*c*).

In case of FIG. 7(*b*), the elastic roller 1 is so modified as to have a taper T at both end parts of the core member 2. In FIG. 7(*c*), the elastic roller is so modified as to have a taper T at both end parts of the foam member 3, which can be made in a simple manner by reducing the thickness of the foam member 3 overlaid on the core member 2 toward the both edges of the developing roller. Of course it is also possible to provide tapered portions on both the core member 2 and the foam member 3.

By modifying the elastic roller 1 in a manner as illustrated in FIG. 7(*b*) or 7(*c*), all the problems mentioned above with reference to FIG. 7(*a*), such as thickening and bulging of the foam member at the end parts of the roller 1, can be solved and therefore the roller 1 is allowed to work uniformly throughout the full width l thereof. Accordingly, these developing rollers as illustrated in FIGS. 7(*b*) and (*c*) are preferably used in the present invention.

Figure 8:
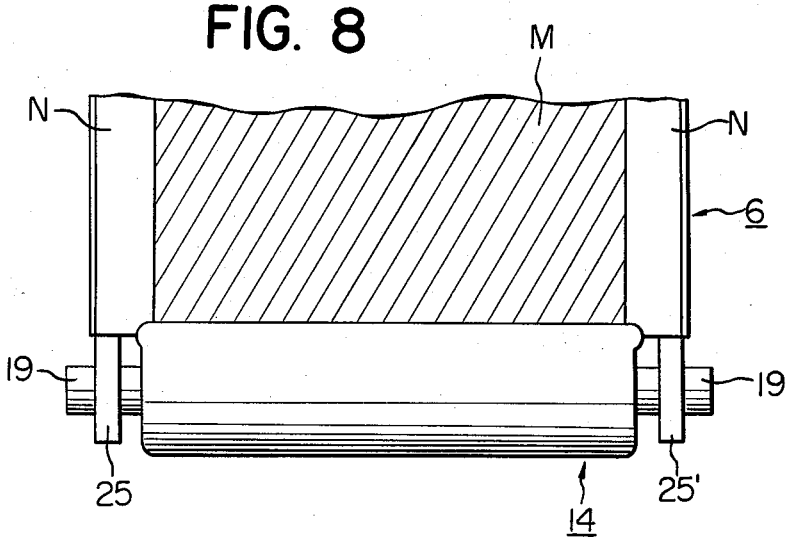

Another useful modification of the developing roller for the present invention is shown in FIG. 8. This modification is featured by the provision of means for limiting the degree of pressure contact deformation of the developing roller.

In FIG. 8, a developing roller is designated generally by 14. The developing roller has a rotary shaft 19 on which rollers 25 and 25' are mounted at the both ends of the shaft. The rollers 25 and 25' which constitute means for limiting the degree of pressure contact deformation of the developing roller 14, are so positioned as to come in contact with the end supporting portions N, N of the photosensitive drum 6 respectively. By selecting the diameter of the rollers 25, 25' suitably, the degree of pressure contact of the developing roller 14 with the photosensitive drum 6 can be adjusted as desired for obtaining a uniform and constant contact therebetween throughout the full length of the roller 14. Since the liquid developer is uniformly supplied to and removed from the entire image forming area M of the photosensitive drum 6, development is carried out with a good result.

Figure 9:
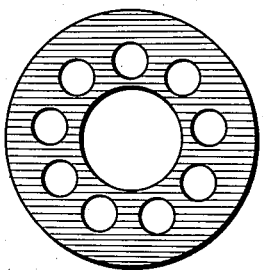
FIGS. 9 and 10 are cross-sectional views of rollers used in the invention showing the shapes thereof in detail.
Figure 10:
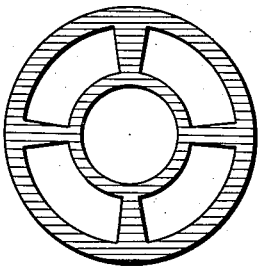

With the arrangement shown in FIG. 8 it may happen that some liquid developer, squeezed out from the nip portion between the photosensitive drum 6 and the developing roller 14, is retained in the space between the developing roller 14 and the roller 25 or 25' while forming a liquid film. Such developer retained in the space may be taken up again by the photosensitive drum and may flow into the backside of the drum in a manner to adversely affect the development. To prevent such a problem, the rollers 25 and 25' preferably have relief openings through which liquid developer can pass away, in the direction of the shaft. The shape of the opening for this purpose is not limitative. For example, the rollers 25, 25' may have such cross section as shown in FIG. 9 or FIG. 10.

As will be understood from the foregoing, the present invention enables various merits and advantages to be derived to the maximum extent from roller type liquid developing. According to the invention, all of the disadvantages involved in the conventional roller type developing apparatus can be eliminated in a very simple and effective manner. The developing apparatus designed in accordance with the present invention has an improved efficiency and an extended useful life as compared with the conventional ones since in the apparatus according to the invention, its developing roller can perform the functions in a stable manner and for a longer time. Troubles usually occuring at the marginal portions of an image on the photosensitive drum, such as distortion or contamination of the image marginal portions and incomplete squeezing of liquid at such portions can be eliminated in accordance with the invention. In order to carry out the present invention no change or modification of the usual photosensitive drum is required. Also, there is no need of enlargement in length of the photosensitive drum. As illustrated in the embodiments, the present invention permits the developing roller to have a roller length less than that of the photosensitive drum. This feature makes it possible to arrange the developing apparatus more compactly as a whole. While the photosensitive medium has been shown to be of drum type, the above described effect of the invention can be obtained equally for the case where the photosensitive medium is in a form of belt.

While the invention has been particularly shown and described with reference to preferred embodiments thereof, it will be understood by those skilled in the art that the foregoing and other changes in form and details can be made therein without departing from the spirit and scope of the invention.

I claim:

1. A wet developing apparatus of the type which is provided with a rotary member for developing an electrostatic latent image carried on a latent image carrier, said rotary member being elastically deformable and being disposed in pressure contact with said carrier while supplying liquid developer thereto and while recovering residual liquid developer therefrom, said apparatus being characterized in that said rotary member is an elastic roller comprising a porous elastic material overlaid on the circumference of the roller shaft, and in that the relative position between said rotary member and said latent image carrier is determined so that the width of said rotary member, measured along the axial direction in which said rotary member comes in pressure contact with said latent image carrier, is within the range of from the maximum width of the area in which an electrostatic latent image can be carried by said carrier to the total width of said carrier.

2. A wet developing apparatus as claimed in claim 1, wherein said rotary member is an elastic roller comprising a shaft like core member, a porous and elastic inner layer provided on the core member in such manner as to enclose said core member, said inner layer including an elastically deformable foam structure and having a liquid retentivity, and a flexible outer layer covering said inner layer, said outer layer having therein openings through which liquid can pass.

3. A wet developing apparatus as claimed in claim 2, wherein said flexible layer is a layer of mesh material.

4. A wet developing apparatus as claimed in claim 1, wherein said rotary member is an elastic roller comprising a shaft like core member, an inner layer of elastic material including an elastically deformable foam structure having a liquid retentivity and being provided on the core member in such manner as to enclose said core member, and an outer layer of flexible material having therein openings through which liquid can pass and provided on the inner layer to cover said inner layer, and being wherein at the both end parts of the elastic roller, either one or both of said core member and said inner layer have tapered portions.

5. A wet developing apparatus as claimed in claim 4, wherein said flexible layer is a layer of mesh material.

6. A wet developing apparatus as claimed in claim 1, wherein said latent image carrier is a photosensitive medium in a form of drum.

7. A wet developing apparatus as claimed in claim 6, wherein the full length of the effective working area of said rotary member is less than the total length of said photosensitive drum.

8. A wet developing apparatus as claimed in claim 6, wherein said rotary member is positioned relative to said photosensitive drum in such a manner that axes of said rotary member and said photosensitive drum are kept in parallel with each other.

9. A wet developing apparatus of the type which is provided with a rotary member for developing an electrostatic latent image carried on a latent image carrier, said rotary member being elastically deformable and being disposed in pressure contact with said carrier while supplying a liquid developer thereto and while recovering residual liquid developer therefrom, said apparatus being characterized in that said rotary member has rollers provided at both ends thereof to form means for controlling the degree of pressure contact between said rotary member and said latent image carrier, said rollers having openings therein through which liquid passes away, and wherein the relative position between said rotary member and said latent image carrier is determined so that the width of said rotary member, measured along the axial direction in which said rotary member comes in pressure contact with said latent image carrier, is within the range of from the maximum width of the area in which an electrostatic latent image can be carried by said carrier to the total width of said carrier.

* * * * *